United States Patent [19]

Rollins

[11] 3,992,061

[45] Nov. 16, 1976

[54] MINING CUTTER BIT ASSEMBLY

[75] Inventor: Lester G. Rollins, Franklin, Pa.

[73] Assignee: Joy Manufacturing Company, Pittsburgh, Pa.

[22] Filed: Apr. 7, 1975

[21] Appl. No.: 565,412

[52] U.S. Cl. ..... 299/86; 299/93; 403/362

[51] Int. Cl.[2] ..... E21C 13/00

[58] Field of Search ..... 403/362; 299/91, 92, 299/93, 86; 37/142 R

[56] References Cited

UNITED STATES PATENTS

| | | | |
|---|---|---|---|
| 1,677,950 | 7/1928 | Bowman | 299/93 |
| 1,958,817 | 5/1934 | Gase | 403/362 X |
| 2,217,348 | 10/1940 | Bowman | 299/93 |
| 2,415,107 | 2/1947 | Morrow | 299/93 |
| 2,996,291 | 8/1961 | Krekeler | 299/92 |
| 3,093,365 | 6/1963 | Krekeler | 299/92 |
| 3,268,260 | 8/1966 | Snipe | 299/91 |
| 3,498,677 | 3/1970 | Morrow | 299/86 |
| 3,749,449 | 7/1973 | Krekeler | 299/86 X |

*Primary Examiner*—Ernest R. Purser
*Assistant Examiner*—Richard E. Favreau

[57] ABSTRACT

A cutter bit assembly for use on, for example, a mining machine and having improved structure to ensure proper locking of a cutter bit in a cutter bit holder and to ensure proper seating of the bit holder in the supporting block therefor. The bearing surfaces between the bit holder and the block are formed so as to ensure full contact between the upper body portion of the bit holder and the block when a shank portion of the holder is secured within the block. The bearing surfaces on the body portion of the holder are angled so as to further ensure proper seating thereof.

15 Claims, 5 Drawing Figures

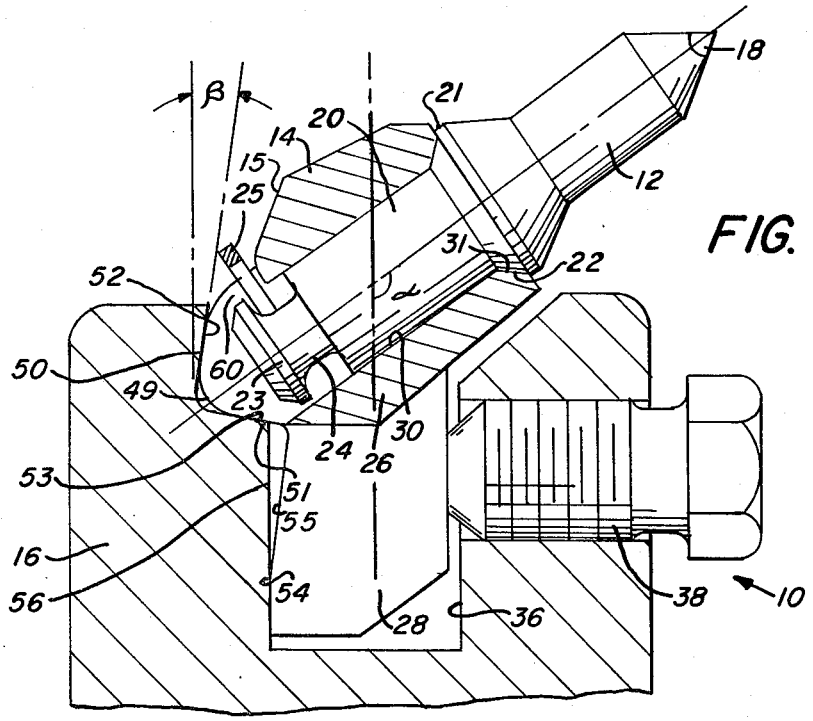
FIG. 1
FIG. 2
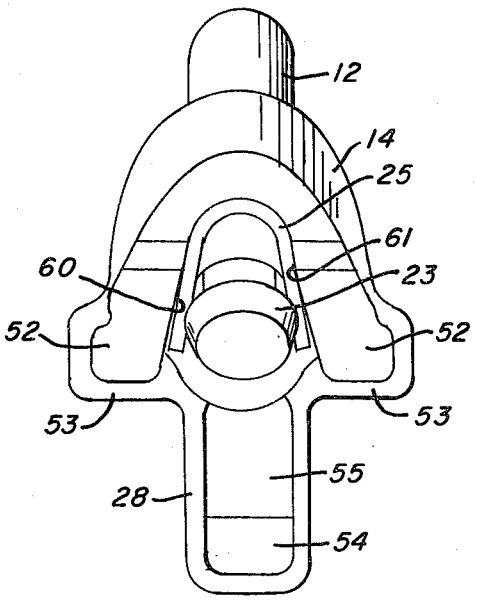
FIG. 3
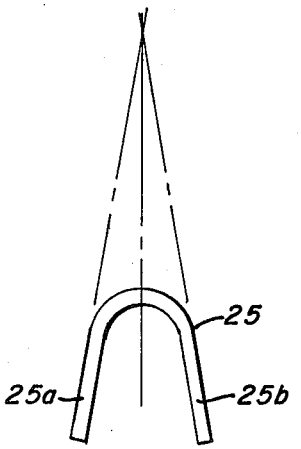

PRIOR ART

MINING CUTTER BIT ASSEMBLY

In mining machinery for use in mining mineral veins of coal or the like, provision is made for supporting and driving cutter bits into cutting engagement with the mineral vein. The cutter bits are positioned in bit holders which in turn are supported by support blocks. The support blocks may be mounted on a driving mechanism in a number of ways such as by welding to a cutter drum or cutter chain or integrally formed with a chain link.

The invention relates to a cutter bit assembly preferably including a cutter bit of the pick type, i.e., a bit having a generally conical bit tip and an axially aligned bit body of generally cylindrical configuration. While cutter bit assemblies of the pick type are known in the art such as those disclosed in U.S. Pat. No. 3,519,309, a number of problems have been encountered in the use thereof. For example, it has been found that there is a problem with prior art assemblies in that the bit holder and block may fail when subjected to the stresses of the cutting operation. The reasons for most of these failures have been traced to either improper seating of the bit holder in the block or a slight misalignment between the bearing surfaces of the bit holder and the block. The improper seating occurs if the shank of the bit holder is secured in the block before the bearing surface of the bit holder meets the bearing surface of the block. The misalignment exists if either the block or holder bearing surfaces are machined rough or at a slightly inaccurate angle.

An additional problem occasionally arises in the prior art assemblies. It has been found that retention of the bit within the holder, and the holder within the block is insufficient to counteract the forces created by the angular acceleration of the driving mechanism as it drives the blocks in a closed path at high speed. It has been the experience with prior art assemblies that both bits and bit holders have been thrown from the mining machine creating a dangerous environment for nearby workers and an inefficient mining operation.

By means of the present invention which includes an improved seating and retention arrangement the hereinabove mentioned problems in prior art devices are overcome, in the least, greatly alleviated, for example: the instant cutter bit assembly is better able to resist without failure the enormous stresses encountered when cutting into a mineral vein; it provides improved integrity of the assembly, and provides easy cutter bit and bit holder replacement.

These advantages as well as still other advantages of the present invention will become more apparent upon reference to the following detailed specification and drawings of the preferred embodiments wherein:

FIG. 1 is a side, sectional view of a preferred embodiment of the cutter bit assembly according to the present invention;

FIG. 2 is a rear, elevational view of the cutter bit holder and cutter bit per se;

FIG. 3 is an elevational view of a retainer spring of the present invention in its normal unstressed shape;

Figure 4:
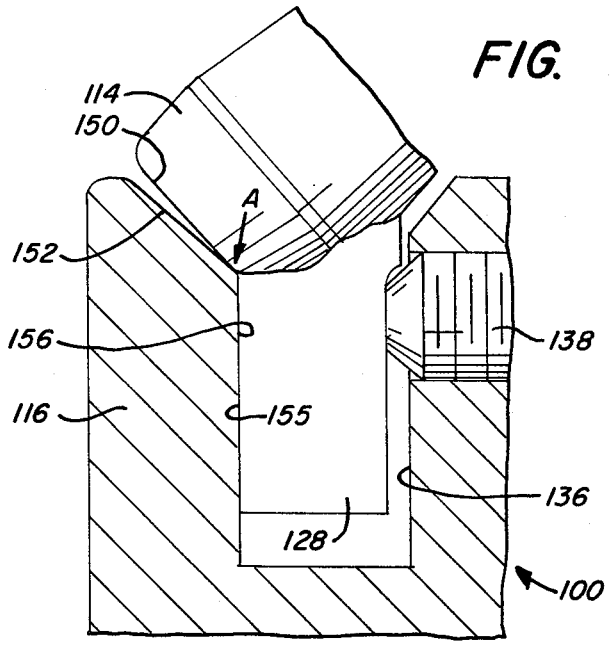
FIG. 4 is a side, sectional view of an example of the prior art depicting one possible problem that may be incurred in the use thereof.

With reference to the drawings and FIG. 1 in particular, there is shown a cutter bit assembly 10 including a cutter bit 12, a bit holder 14, and a support block 16. The cutter bit 12 is of the pick type and is comprised of a conical bit tip 18 integral with and located at a forward end of a generally cylindrical bit body 20. Intermediate the ends of bit body 20 is an integral radially outwardly extending flange portion 21 which defines on a rearward side thereof an annular bearing surface 22. At the rearward end of bit body 20 is formed an annular locking groove 24. A resilient, generally U-shaped keeper or retaining spring 25 cooperates with locking groove 24 to retain the cutter bit 12 within bit holder 14 in a manner to be more fully described hereinafter.

The bit holder 14 includes a body portion 26 and an integral shank portion 28. Extending through the body portion 26 of holder 14 is a cylindrical bore 30 having a longitudinal axis which intersects the longitudinal axis of the shank portion 28 at an obtuse angle $\alpha$ which is selected according to the particular mining application for which it is intended. The inside diameter of bore 30 is slightly larger than the diameter of body portion 20 of cutter bit 14 so that the cutter bit 12 may be inserted into bore 30 until the annular bearing surface 22 meets a complementary annular bearing surface 31 on holder 14. It is to be noted that while bearing surfaces 22 and 31 are shown projecting outwardly in a forward direction they may be formed at any desired angle, for example the annular surfaces may be at right angles with the axes of the bore 30 and cutter bit 12. Rearward of bore 30 on holder 14 is formed bearing surfaces 50 and 51. From the rearwardmost point 49 of holder 14 surface 50 extends upwardly and forwardly at an acute angle $\beta$ of approximately between 5° and 30° from the vertical (as viewed in FIG. 1), and surface 51 extends from the point 49 forwardly and preferably slightly downwardly for purposes to be described hereinafter. It is stressed that while a preferred range for angle $\beta$ has been offered, any acute angle will function properly to fulfill the objects of the invention. Another bearing surface 54 extends along the lower rearward side of shank portion 28 of holder 14. This bearing surface 54 is offset slightly rearward from the surface 55 thereabove for a purpose also to be described hereinafter.

Formed within support block 16 is an indentation or socket 36. A set screw 38 threadingly engages support block 16 so as to extend within socket 36 at the forward side thereof. At the upper end of rearward side 56 of socket 36 there are formed bearing surfaces 52 and 53 which are angled so as to correspond with the respective bearing surfaces 50 and 51 of holder 14 as explained hereinafter.

Upon insertion of cutter bit 12 into bore 30 until bearing surface 22 of bit 12 meeting bearing surface 31 of holder 14, the legs 25*a*, 25*b* of the generally U-shaped keeper 25 are inserted into groove 24 by compressing the legs 25*a*, 25*b*slightly together, and thereby blocking forward movement of end portion 23 of cutter bit 12 out of holder 14. Due to the fact that the legs 25*a*, 25*b* of keeper 25 are normally sprung outwardly as shown in FIG. 3, the keeper 25 will be retained within holder 14 between inwardly sloping walls 60 and 61 (FIG. 2). In this manner cutter bit 12 will be captively retained within holder 14. Also, due to the fact that the keeper 25 is normally sprung outwardly, the legs 25*a*, 25*b* will not engage the peripheral surface of the bit 12 within groove 24, thus allowing the bit to rotate within bore 30 as is known to be desirable in the art.

When it is desired to mount holder 14 within block 16, shank portion 28 of holder 14 is inserted into socket 36 until bearing surface 51 of holder 14 meets bearing surface 53 of block member 16. The set screw 38 is then tightened, thus forcing bearing surface 54 of shank 28 against rear wall 56 of socket 36. Also, since the point of contact between set screw 38 and shank 28 is above bearing surface 54, and since upper surface 55 is spaced from wall 56, the holder 14 will pivot about surface 54, thus bearing surface 50 of holder 14 is forced into contact with bearing surface 52 of block member 16. Further, if set screw 38 is inadvertently tightened before contact is made between surfaces 50 and 52 or if mineral particles within socket 36 initially prevent such contact, the angle of surface 50 produces a cam effect which forces the holder 14 down into socket 36 until surface 51 meets surface 53. The importance of this novel interaction between bearing surfaces can be more fully described with reference to an example of the prior art which is represented in FIGS. 4 and 5.

FIG. 4 shows an example of a prior art cutter bit assembly 100 including a cutter bit (not shown), a bit holder 114, and a support block member 116. Cutter bit assembly 100 is utilized in much the same manner as cutter bit assembly 10 of the present invention. The shank 128 of holder 114 is secured within socket 136 of block member 116 by a set screw 138. The rearward wall 155 of shank 128 is flat and is designed to meet flush with rear wall 156 of socket 136. Bearing surface 150 on holder 114 is flat and designed to meet flush with another flat bearing surface 152 on block 116.

One problem encountered with the prior art device as shown in FIG. 4 is that it is very difficult to economically fabricate the holder 114 and block member 116 having respective bearing surfaces 150 and 152 which will meet flush when shank 128 is secured in socket 136 by set screw 138. If the two bearing surfaces 150 and 152 are formed so that they do not meet flush with each other as represented in FIG. 4 there will exist a tremendous stress at point "A" which could easily lead to failure of the assembly by either breaking of the holder 114 or crushing of the surface 152 at point "A". The problem represented by FIG. 4 could occur if the angles of surfaces 150 and 152 differ only slightly or if either surface is slightly rough creating point contact.

Figure 5:
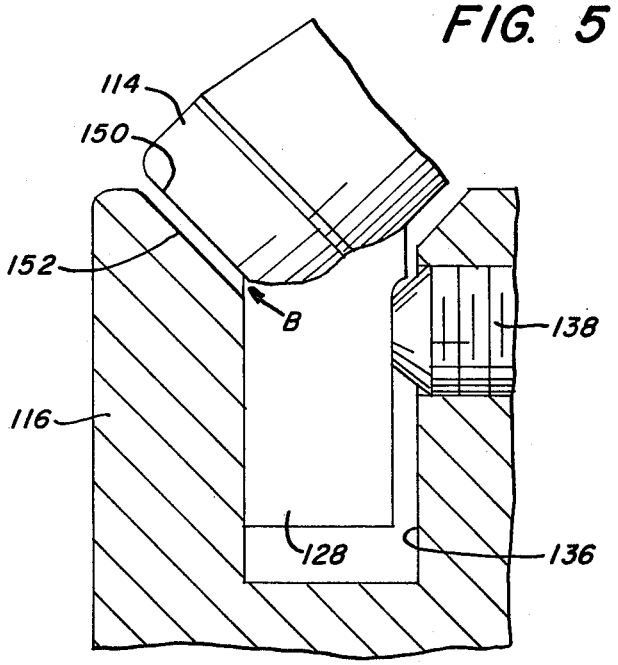
PRIOR ART FIG. 5
FIG. 5 is a side, sectional view of an example of the prior art depicting another possible problem that may be incurred in the use thereof.

A second problem encountered with the prior art is depicted in FIG. 5. If the prior art holder 114 is secured within socket 136 by set screw 138 before surfaces 150 and 152 meet as shown in FIG. 5, the shank 128 may break at point "B" due to the extreme stress exerted on that point during the mining operation. This problem may occur if the operator tightens the set screw 138 before making sure surfaces 150 and 152 are in contact, or if particles in socket 136 stop the inward movement of shank 128 giving the operator the impression that the holder 114 is fully seated. Also, the tightening action of the set screw 138 alone may tend to move the holder 114 slightly out of block 116 thus causing surfaces 150 and 152 to be separated. It is noted that while the gaps between surfaces 150 and 152 may be exaggerated in FIGS. 4 and 5, it is only necessary that the slightest gap exist to produce the above described deleterious stress concentrations.

Another problem inherent in the prior art assembly of FIGS. 4 and 5 is that if the set screw 138 is not tightened sufficiently or becomes loose during the mining operation the holder 114 will be thrown out of socket 138 due to the angular acceleration exerted thereon as it is driven in a closed path during the mining operation.

The present invention solves all of the above enumerated problems in the following manner. If the operator fails to place the shank 28 completely down into socket 36, i.e. until surface 51 meets surface 53, before beginning to tighten set screw 38, the slanted surface 52 on block 16 will act as a cam to force the holder 14 into block 16 as the set screw is tightened. This feature ensures proper contact between the intended bearing surfaces 51 and 53 and eliminates the possibility of excessive stresses occurring at other unreliable points on the holder 14. Also, due to the fact that the point of contact between the set screw 38 and shank 28 is spaced above the point of contact between bearing surface 54 and wall 56 of socket 36, the bearing surface 50 of holder 14 is forced into contact with bearing surface 52 of support block 16 as the set screw 38 is tightened. This feature also ensures that the camming action between surfaces 50 and 52 is carried out as set forth above. Another important feature of the present invention resides in the fact that if the set screw 38 is not tightened completely by the operator or if it loosens slightly during the mining operation, the holder 14 will still be captively retained in support block 16 due to the upper edge of slanted surface 52 of block 16 being forward of the rearwardmost point 49 of holder 14.

The novel cutter bit retaining means of the present invention provides for better retention of cutter bit 12 in holder 14 while allowing easy replacement of the cutter bit when it becomes worn. In order to remove the cutter bit 12 from holder 14 it is merely required that a screw driver or similar tool be inserted under the arch of the keeper spring 25 allowing the keeper to be easily pried out of its seat between walls 60 and 61; the holder 14 is beveled near the keeper 25 as shown at 15 to permit insertion of a tool through the keeper to facilitate removal of the keeper. However, the cutter bit 12 will be sufficiently secure within holder 14 during the mining operation since the forces generated are not sufficient to cause full diameter portion 23 of cutter bit 12 to shear the keeper 25 which is set within groove 24 as set forth above.

Various modifications can be made to the invention as described hereinabove without departing from the spirit and scope thereof, for example: the rear wall 55 of shank 28 may be made flat and rear wall 56 of block 16 fabricated to be spaced from the shank 28 at the location opposite set screw 38 thus providing the same advantage as discussed above; the bit may be other than the pick type; the bit may be unitary with the holder. Accordingly, the scope of the present invention is to be interpreted only in accordance with the scope of the claims as set forth hereinafter.

What is claimed is:

1. A block for supporting and retaining a cutter bit holder comprising a body having an elongated socket formed therein which extends along a longitudinal axis; securing means for tightening and holding a cutter bit holder in said socket; at least one substantially planar bearing surface formed at the entrance of said socket and on a side of said socket opposite said securing means; said bearing surface extending in a direction outwardly of said socket and towards said axis.

2. A cutter bit holder comprising: a body; a bore extending through said body, a forward end of said bore adapted to initially receive a cutter bit having a locking groove on a rearward end thereof; said body including a pair of wall means adjacent to and extending axially outwardly away from the rear end of said bore for captively retaining a cutter bit keeper therebetween; said pair of wall means being angled with respect to each other and diametrically spaced from each other with respect to said bore.

3. A cutter bit holder comprising: a body portion and a shank portion; a bore extending through said body portion, a forward end of said bore adapted to initially receive a cutter bit having a locking groove on a rearward end thereof; said body portion including a pair of wall means adjacent to and extending axially outwardly away from the rear end of said bore; said pair of wall means being angled with respect to each other and generally diametrically spaced from each other with respect to said bore; a resilient cutter bit retaining keeper having a pair of normally diverging legs and an intermediate connecting portion between said legs; said legs being constrained between said pair of wall means and adapted to be within such locking groove and spaced from the periphery of such cutter bit to retain such cutter bit within said bore while allowing such cutter bit to freely rotate within such bore; and said intermediate connecting portion of said keeper extending outwardly of said wall means to allow access thereto for removal of said keeper from said holder.

4. A cutter bit holder as specified in claim 3 wherein said body portion adjacent said connecting portion of said keeper is spaced from said cnnecting portion to permit insertion of a tool through the keeper inwardly of said connecting portion for removal of said keeper from said holder.

5. A cutter bit holder comprising: a body portion adapted to hold a cutter bit; an elongated shank portion extending along a longitudinal axis and being adapted to be inserted into a block; said body portion including at least one substantially planar bearing surface adapted to bear against such a block; said at least one bearing surface extending from a point on said body portion in a direction away from said shank portion and towards said axis and forming an acute angle with the line which is parallel to said axis and passes through said point.

6. A cutter bit holder of claim 5 wherein: said body portion including a second bearing surface positioned between said shank portion and said at least one bearing surface and lying in a plane which intersects said line and said axis.

7. A cutter bit holder of claim 5 wherein: said body portion includes an elongated bore therethrough; and an annular bearing surface adapted to bear against a cutter bit and surrounding said bore at an end adapted to receive such a cutter bit.

8. The cutter bit holder of claim 5 wherein: said shank portion includes a forward side adapted to be engaged by a set screw at a predetermined area and a rearward side opposite said forward side; a bearing surface on said rearward side; said bearing surface being spaced from the intersection of said shank portion and said body portion by an intermediate surface portion; and said intermediate portion being directly opposite said area.

9. The cutter bit holder of claim 5 wherein: said body portion includes an elongated bore therethrough a forward end of said bore adapted to initially receive a cutter bit having a locking groove at a rearward end portion thereof; said body portion including means to captively retain a generally U-shaped member which is adapted to be inserted into such groove to hold such cutter bit within said bore.

10. The cutter bit holder of claim 9 wherein: said means include walls on opposite sides of the rearward end of said bore which extend away from said shank portion and toward each other.

11. A cutter bit assembly comprising: a block including a socket therein; a cutter bit holder including a body portion adapted to hold a cutter bit and an integral elongated shank portion having a free end insertable into said socket; securing means carried by said block for contacting said shank portion on a forward side thereof and at one axial location thereof to urge said holder rearwardly to provide secure engagement between a rear bearing surface of said body portion and said block and between said block and a rear area of said free end of said shank portion; and the section of the rear side of said shank portion corresponding in axial location to said first location and extending to said body portion, being spaced from said block; whereby, as said securing means urges said holder rearwardly, said holder will pivot on said rear area until said rear bearing surface contacts said block.

12. A cutter bit assembly as specified in claim 11 wherein said rear bearing surface extends from a point on said body portion in a direction away from said shank portion and towards the longitudinal axis of said shank portion.

13. A cutter bit assembly as specified in claim 12 wherein said body portion additionally comprises at least one other bearing surface movable into contact with a mating bearing surface on said block; said other bearing surface being between said shank portion and said rear bearing surface and lying in a plane which intersects said axis.

14. A cutter bit assembly as specified in claim 11 wherein said engagement between said body portion and said block is between said rear bearing surface on said body portion and a second bearing surface on said block matable with said rear bearing surface; said body portion including a third bearing surface and said block including a fourth bearing surface matable with said third bearing surface; and means for forcing said third and fourth bearing surfaces together as said securing means urges said rear and second bearing surfaces together.

15. A cutter bit assembly as specified in claim 14 wherein said means for forcing said third and fourth bearing surfaces together includes: said second bearing surface being angled toward the opening of said socket so that as said rear and second bearing surfaces are forced together said second bearing surface acts to cam said cutter bit holder into said socket until said third bearing surface engages said fourth bearing surface.

* * * * *